US010058139B2

(12) United States Patent
Kay et al.

(10) Patent No.: US 10,058,139 B2
(45) Date of Patent: Aug. 28, 2018

(54) CAP WITH A BILL HAVING UPPER AND LOWER PORTIONS DISPLAYING INFORMATION WHEN SPACED-APART

(71) Applicant: Cisco Sales Corp., Torrance, CA (US)

(72) Inventors: Jordan S. Kay, Torrance, CA (US); Neil J. Kay, Torrance, CA (US)

(73) Assignee: Cisco Sales Corp., Torrance, CA (US)

( * ) Notice: Subject to any disclaimer, the term of this patent is extended or adjusted under 35 U.S.C. 154(b) by 0 days.

(21) Appl. No.: 14/279,277

(22) Filed: May 15, 2014

(65) Prior Publication Data

US 2015/0327613 A1 Nov. 19, 2015
US 2018/0020757 A9 Jan. 25, 2018

Related U.S. Application Data

(63) Continuation-in-part of application No. 13/894,584, filed on May 15, 2013, now Pat. No. 9,003,570.

(51) Int. Cl.
*A42B 1/06* (2006.01)
*A42B 1/24* (2006.01)
*A42B 1/00* (2006.01)

(52) U.S. Cl.
CPC ..... *A42B 1/064* (2013.01); *A42B 1/004* (2013.01); *A42B 1/242* (2013.01); *A42B 1/245* (2013.01)

(58) Field of Classification Search
CPC ..... A42B 1/24; A42B 1/064; A42B 1/004; A42B 1/242; A42B 1/245; A42B 1/002; A42B 1/06; A42B 1/248
USPC ..... 2/10, 209.13, 195.7
See application file for complete search history.

(56) References Cited

U.S. PATENT DOCUMENTS

| | | | | | |
|---|---|---|---|---|---|
| 911,126 | A | * | 2/1909 | Harrison | 2/171.6 |
| 1,716,719 | A | * | 6/1929 | Christopher | 2/10 |
| 1,735,705 | A | * | 11/1929 | Wittcoff | 2/10 |
| 2,648,847 | A | | 8/1953 | Crowder | |
| 2,735,109 | A | | 2/1956 | Feldman | |
| 3,605,115 | A | * | 9/1971 | Bohner | 2/10 |
| 4,985,935 | A | | 1/1991 | Hur | |
| 5,197,150 | A | | 3/1993 | Bedient | |
| 5,253,368 | A | | 10/1993 | Blake | |
| 5,276,985 | A | * | 1/1994 | Halloran | 40/329 |
| 5,328,399 | A | * | 7/1994 | Reynolds | 446/27 |
| 5,343,568 | A | * | 9/1994 | May | 2/195.1 |
| 5,494,445 | A | * | 2/1996 | Sekiguchi | A63F 3/0421 40/436 |
| 5,510,961 | A | * | 4/1996 | Peng | 362/106 |
| D416,376 | S | * | 11/1999 | Schmalschlager et al. | D2/869 |

(Continued)

*Primary Examiner* — Shaun R Hurley
*Assistant Examiner* — Bao-Thieu L Nguyen
(74) *Attorney, Agent, or Firm* — Inskeep IP Group, Inc.

(57) ABSTRACT

A flip cap which has crown and bill portions, the bill having upper and lower members, at least one of the upper and lower members having a surface capable of displaying info nation secured thereto when the upper and lower members are spaced-apart.

The lower and upper bill members are secured in a first position to each other by using a plurality of holes formed in the upper bill member and a plurality of aligned pin members formed in the lower bill member, a lower edge formed on the upper bill member enabling it to engage at least two of the pin members formed on the lower bill member when the lower and upper bill members are spaced-apart, thereby maintaining the lower and upper bill members in the spaced-apart position.

17 Claims, 17 Drawing Sheets

(56) References Cited

U.S. PATENT DOCUMENTS 6,079,052 A * 6/2000 Veridiano ..... 2/172
6,088,837 A 7/2000 Baker
6,151,712 A * 11/2000 Lampi ..... 2/10
6,173,447 B1 * 1/2001 Arnold ..... 2/10
6,237,156 B1 * 5/2001 Ellman et al. ..... 2/195.1
6,557,180 B2 5/2003 Hall McKensie
6,959,454 B2 * 11/2005 DeWinter ..... 2/195.1
6,969,178 B2 11/2005 Zuloff
6,993,794 B2 * 2/2006 Hall et al. ..... 2/195.1
6,994,445 B1 * 2/2006 Pomes ..... 362/106
7,185,371 B2 * 3/2007 Koo ..... 2/209.13
D612,134 S * 3/2010 Hoffman ..... D2/872
8,025,395 B2 * 9/2011 Quintana ..... 351/86
8,277,069 B2 10/2012 Zuloff
9,003,570 B2 * 4/2015 Kay et al. ..... 2/195.1
9,027,165 B2 * 5/2015 Cunningham ..... 2/209.13
2001/0049837 A1 * 12/2001 Slack ..... 2/6.2
2002/0053101 A1 * 5/2002 Slack ..... 2/7
2005/0078473 A1 * 4/2005 Zuloff ..... 362/106
2006/0029216 A1 * 2/2006 Burns ..... 379/430
2006/0230497 A1 * 10/2006 Thompson ..... 2/175.5
2006/0242751 A1 * 11/2006 Koo ..... 2/171
2007/0028370 A1 * 2/2007 Seng ..... 2/410
2008/0229470 A1 * 9/2008 Kim ..... 2/12
2009/0193565 A1 * 8/2009 Wilens ..... 2/209.13
2010/0186147 A1 * 7/2010 Garza ..... 2/209.12
2011/0061145 A1 * 3/2011 Zuloff ..... 2/209.13
2011/0088142 A1 * 4/2011 Holley ..... 2/209.13
2011/0088143 A1 * 4/2011 Lee ..... 2/209.13
2012/0110718 A1 * 5/2012 Kim ..... 2/209.12
2012/0180180 A1 * 7/2012 Steve et al. ..... 2/12
2013/0031803 A1 * 2/2013 Koch et al. ..... 36/100
2013/0305437 A1 * 11/2013 Weller et al. ..... 2/422
2014/0070957 A1 * 3/2014 Longinotti-Buitoni et al. ..... 340/870.01
2014/0270685 A1 * 9/2014 Letke ..... A42B 1/244 386/224
2014/0304890 A1 * 10/2014 Carra ..... 2/209.12
2014/0304891 A1 * 10/2014 Waters ..... 2/209.13
2014/0338097 A1 * 11/2014 Kay et al. ..... 2/195.1
2014/0338099 A1 * 11/2014 Marscellas ..... 2/209.13
2015/0047100 A1 * 2/2015 Wilson ..... 2/209.3
2015/0130945 A1 * 5/2015 Yu et al. ..... 348/158
2015/0143601 A1 * 5/2015 Longinotti-Buitoni et al. ... 2/69

* cited by examiner

CAP WITH A BILL HAVING UPPER AND LOWER PORTIONS DISPLAYING INFORMATION WHEN SPACED-APART

RELATED APPLICATIONS

This application is a continuation-in-part of application Ser. No. 13/894,584, filed on May 15, 2013 entitled Cap With A Bill Having Upper And Lower Portions Displaying Information When Spaced-Apart (now U.S. Pat. No. 9,003,570 issued Apr. 14, 2015).

BACKGROUND OF THE INVENTION

1. Field of the Invention

This invention relates to improving headgear that is comprised of a visor that flips open and closed, the visor having a fixed lower portion and a movable upper portion. Both bill portions have the capability of visually displaying information to a person near the wearer.

2. Description of the Prior Art

Various types of caps having a bill that can move from a first to second position for entertainment and advertising purposes have been available in the prior art.

For example, U.S. Pat. No. 4,777,667 to Patterson et al discloses a flip bill cap wherein the bill portion is adapted to be raised to disclose an entertaining and advertising message thereon. The bill portion is activated by the cap wearer using either a string or a solenoid. Indicia is formed directly on the underside of the bill portion in one embodiment and in a second embodiment, the bill portion has a track, or slot, formed therein. A card having indicia formed thereon is slideable within the track to be viewed through a window when the bill portion is moved to the angularly upright position.

The mechanism disclosed for moving the bill to its angular position is awkward and expensive and thus what is desired is to provide a cap flip bill for displaying messages which a simpler and less expensive than caps currently available including the cap disclosed in the '667 patent.

Other prior art that illustrate flip type caps include U.S. Pat. No. 4,985,935 to Hur; U.S. Pat. No. 5,343,568 to May and Des. 321,274 to Hur.

SUMMARY OF THE INVENTION

The present invention provides improvements upon a flip bill cap (or visor) that has a bill comprised of upper and lower portions. These portions display artwork when the upper bill portion is flipped up (separated) from lower bill portion. The objective of the invention is to provide improvements in the functionality and construction, and specifically:

(1) Use of a pressure point hinge system where upper bill and lower bill are completely separate entities; the upper bill is cut with precision in regards to location and size, thus creating a functionally sound hinge mechanism with maximum surface area for artwork. When the hinge mechanism is in place, a cut out portion of the top visor creates two lengthened legs that produce pressure on the outer most points of the lower visor; the pressure creating a natural curve of the lower bill portion. The ability to curve the bottom bill while the top bill member is upright allows improved protection from the sun versus bottom bills that are straight, or horizontal. Other headgear of similar nature have their lower bill remain flat when flipped open, while the lower bill of the present invention preserves a natural curve synonymous with the comfort and style of a classic baseball cap.

(2) Using oval designed female snap closure openings on the upper bill in conjunction with a specific tolerance in regards to thickness of upper and lower bills allowing the bottom male pins to move naturally side to side when the cap bill is curved or bent by wearer while in the locked and snap closed position. Similar caps do not have an oval snap closure design; therefore brims of similar caps are designed not to be curved so that the integrity of the plastic male pins are compromised. Oval openings allow for the male pins closure system to stay intact and be unaffected by bill bending by the user. This feature allows the cap to maintain its primary function of locking in place and snapping closed with extended use, therefore adding to the overall functioning lifespan of the flip bill cap.

(3) Adding rivets allows the cap design to work in conjunction with the two bill portions which guarantee that the pressure point hinge flip system works soundly. Rivets are installed in the middle portion of the specified cut of the upper bill. Rivets go through both upper and lower bill portions and are permanently sealed, thus adding pressure to both bill corners ensuring the pressure point system is sound. The functionality of the design relies on these pressure points, ensuring the male pins align to the female oval snap closures and the cap remains upright while in its flipped up state.

(4) Using a specific plastic based material in conjunction with an exact tolerance of thickness allows both upper and lower bills to be easily curved down when both upper and lower bills are snapped closed. This also permits the upper bill to curve back to the natural contour of a users head providing a more comfortable fit while the upper bill portion is in an upright position. The curved, rounded contour of the flipped upper bill member provides an improved viewing angle of artwork/signboard to be publicly viewed.

(5) An improved cut on the upper bill member creates lengthened structural legs that stand upright when upper bill member is flipped up. These legs are positioned at the outer most edges of the lower bill member where the upper and lower bill members meet. This creates more surface area and increased overall height in the upper bill member art board when the upper bill member if flipped open. Prior art designs such as that disclosed in U.S. Pat. No. 5,343,568 disclose an upper bill member that when flipped up does not extend past the crown of a standard baseball cap.

(6) Using an improved printing material made from a satin cloth fabric for applying to plastics. The elasticity of the satin fabric is key as it plays an important role when applied to the inside of the upper and lower bills. In particular, they now become one cohesive piece which allows for increased bendability and product lifespan.

(7) Improved process of applying artwork on the upper and lower bill members (sublimation heat transfer onto satin cloth fabric). This procedure starts with a 4-color process artwork sublimated to satin fabric. Next, the sublimated fabric requires a laser cutting machine used to produce perfect oval openings for the upper bill, as well as perfect circular openings cut into the fabric for the lower bill member. Because the laser cut holes in both the lower and upper bill portion are precise, hand labor is not required. A custom steel mold shaped to accept both upper and lower bill members is heated to a specific tolerance so that any plastic material is not melted. The satin cloth fabric is glued to the upper and lower bill portions. The custom steel mold heat machine then firmly presses down on bill member and fabric to make the satin cloth and bill an integral member. This process is done to both upper and lower bill members separately. Prior art caps having the flipping feature do not have a satin cloth fabric, which is adhered to the upper and lower bill portions. The satin cloth sublimated fabric is thinner, more versatile, has more elasticity, is water resistant, and is crease resistant as opposed to prior art designs.

Other potential uses of the upper and lower bill portions are as follows:

(a) Providing a polished upper and lower bill member (with specific tolerances to the point of polish) that easily allows a dry erase marker to be written on and erased from the upper bill member thus providing a blank dry erase surface for a user to create custom artwork.

(b) Directly integrating a Quick Response Code (QR code) on the upper or lower bill members allowing users to scan a code with a smart device (phone, tablet, etc) and then be directed to an online web page.

(c) Directly integrating a specifically printed augmented reality marker within the artwork on the upper and lower bill members, the marker allowing it to be scanned by smart devices (phone, tablet, etc.) providing an interactive experience while viewing from a smart device based on the specific software that has been developed for this individual marker.

(d) Installing a lenticular lens over the artwork on upper and lower bill members allowing a 2d image on the bill members to appear as a holographic 3d image; this creates an illusion of depth, or ability to change or move as the image is viewed from side to side. The lens requires a laser cutting machine used to produce accurate oval openings for the upper bill as well as accurate circular openings cut into the fabric for the lower bill member.

(e) Installing electronic connection points in the middle of both upper and lower bills to activate electronic functions such as sound, light, etc. When the upper bill member separates from the lower bill member the connection points are then disconnected and an electronic function activates. Wire running from connection points seamlessly runs behind the headband material exiting at either side of the two front panels. This wire is connected to a removable battery bay that can be recharged separately using a standard electrical outlet as well as removable rechargeable batteries. When in use the battery bay will be directly attached to a portion of the cap. Components that will be activated through the connection points include, but are not limited to the following:

Led lights
Digital displays (such as a liquid crystal display ("LCD") text ticker)
Preloaded sound chips
Speakers
Camera (still images and video recording)
Electra luminescent panel (f) Infusing a glow in the dark plastic during the molding process in both upper and lower bill members with both bill members having the ability to glow; a fabric that has been prepared with a die cut message will be adhered to the upper and lower bill members. This die cut message will now be the only area that glows on the upper and lower bill members by the luminescent plastic showing through the die cut.

(g) Infusing magnetic shavings during the molding process in the upper and lower bill members or applying a thin magnetic film over upper and lower bill members enable the bill members (same process as described with satin fabric applied as shown in FIGS. 16A and 16B) to become fully magnetized in all areas, not only specific locations. With the entire surface of the upper and lower bills fully magnetized this allows for enhanced interactivity and customization; die cut magnets and other magnetic accessories can now be placed on the cap in conjunction with artwork to further customize the cap and interact with the end user.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
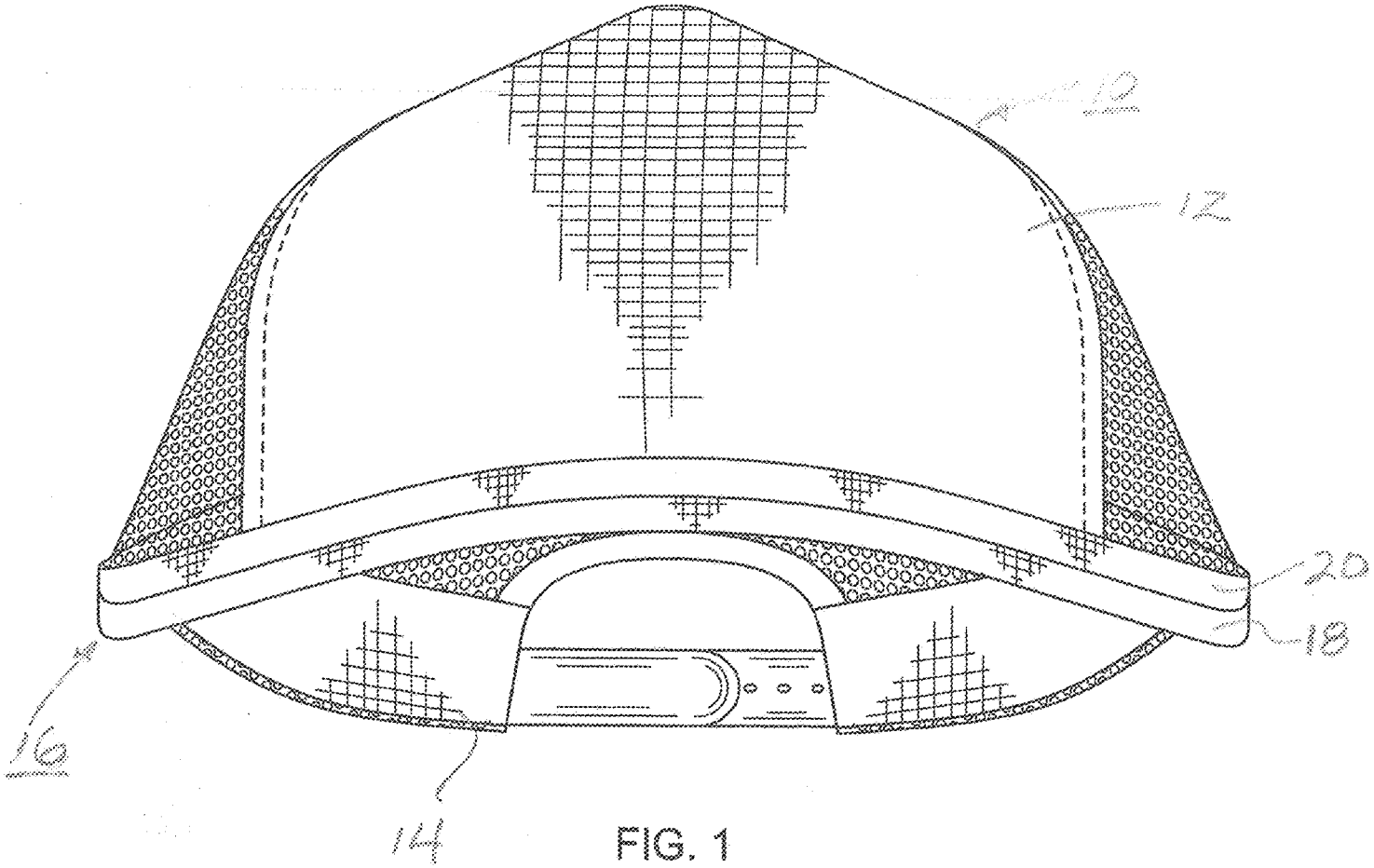
FIG. 1 is a front view of a cap in accordance with the teachings of the invention with upper and lower bill portions positioned together.
Figure 3:
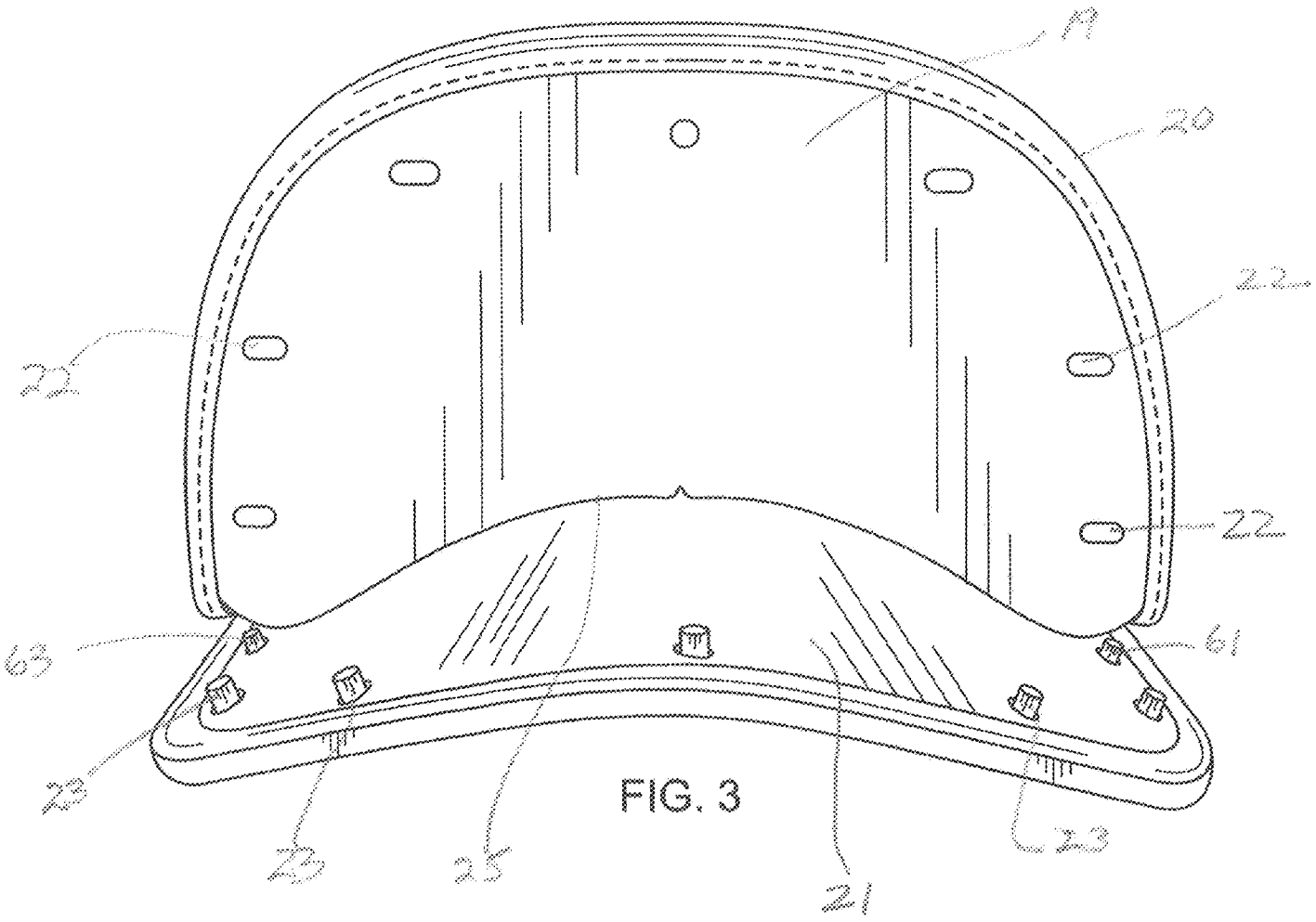
FIG. 3 is a front elevational view of the cap with the bill portions spaced apart.
Figure 4A:
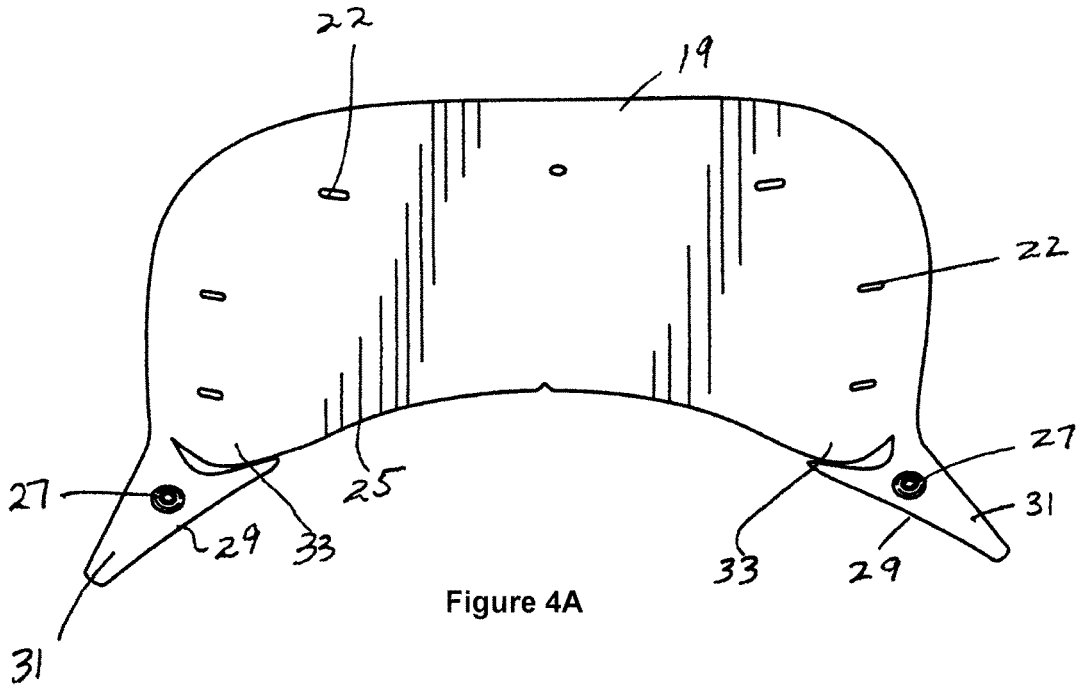
FIG. 4A is a view of upper plastic cut-out piece forming the upper bill portion and FIG. 4B is a view of lower plastic cut-out piece forming the lower bill portion.
Figure 4B:
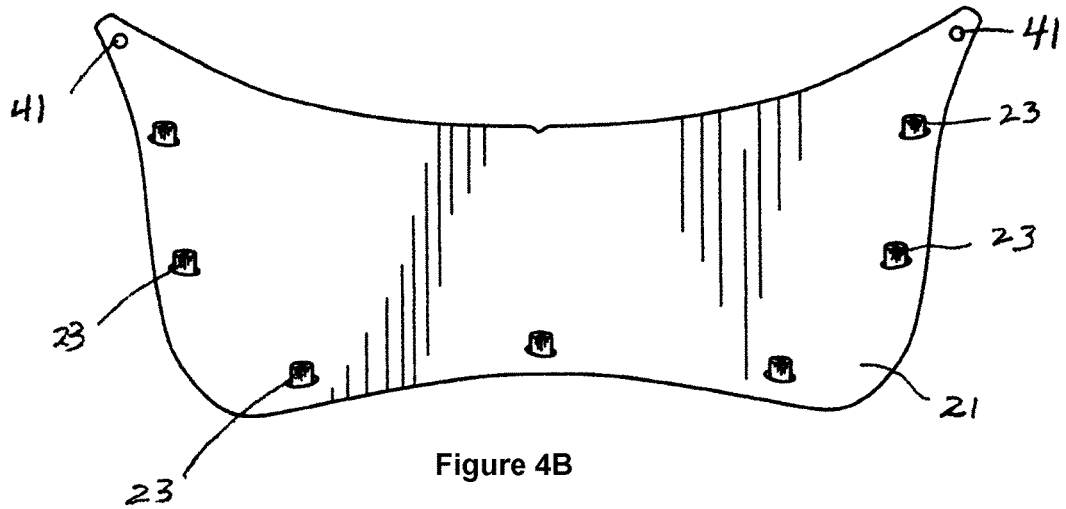

FIG. 1 is a front view of a flip cap 10 incorporating the teachings of the present invention (note that the present invention can be used as a flip visor). Cap 10 includes a crown portion 12 to be worn on the head of a wearer and a headband 14. Bill portion 16 comprises lower member 18 and upper member 20, upper member 20 being pivotally connected to lower member 18. Upper member 20 is removably secured to lower member 18, a plurality of oval shaped openings, or holes, 22 (FIG. 3), formed thereon engaging upright male pins 23 secured to lower member 18 when the upper and lower members are pushed together by the wearer. Rivets 27 (see FIGS. 4A and 4B) formed on upper bill member 20 go through aligned openings 31, and 41 in lower bill portion 18 secure both bill pivoting securely. When it is desired to display a message placed on the surface of a plastic sign board 19 sewn to upper member 20 as shown in FIG. 3, upper member 20 is separated from lower member 18 by the wearer and moved upwardly to a position at a substantially right angle to lower member 18. The lower edge portion 25 of member 20 is designed to lock the member in the display position until a user decides to no longer display the message as described hereinafter.

The bill members 18 and 20, when snapped together, makes cap 10 look like a conventional bill cap prior to being flipped, or moved, by the user; the act of flipping causes the pins 23 formed on member 18 to be released from holes 22, upper member 20 manually rising up until it is in its fixed/locked position.

The message 27 (FIG. 5) can be created by using dry erase pen 29 (the pen can also be used to write on the surface of the lower bill member 18. The mold used to produce this bill is polished to a specific tolerance so that pen 29 easily writes and erases on both bill members).

The bill member 20 is an assembly comprising the upper bill member board 19 and fabric covering the upper bill member board 19. The upper bill member board 19 is preferably a plastic single piece, with a curved cut that include two leg portions 33 formed at both corners thereof to create a locking hinge, the two end portions of board 19 being cut in a rounded pattern to the edge of sew lines formed therein. This enables bill member 20 to flip and stay standing on its own without resting on the surface of lower bill member 18. The hinge function allows the upper bill member 20 to move up and then back down to snap closed. In particular, the furthest back end of upper bill member board 19 has a pair of essentially triangular shaped pieces 31 cut therein. The cut functions as an anchor point allowing bill member 20 to be flipped up while remaining joined to the lower bill member 18. The curved cut legs 33 of the upper bill member board 19 allow upper bill member 20 to be flipped while the end triangular pieces 31 in FIGS. 4A and 4B thereof remain housed and connected to the bottom bill member 18. The two triangular pieces 31 are stitched through to the bottom bill member 18 while legs 33 of the upper bill member 20 are movable substantially 90 degrees to the bottom bill member 18 since it is not stitched thereto. The curved cut out design enables the triangular portions 31 of the upper bill member board 19 to be stitched to the bottom bill member 18 while allowing the curved cut out 25 portion "to slide" forward and rest on the bottom of bill member 18. At the same time, upper bill member board 19 is held securely in place, creating a 90 degree viewing angle for the upper bill member board 19. While the upper bill member board 19 is movable up to a 90 degree angle, the triangular end pieces 31 are non-movable and remain stationary. When flipped back down, the curved edge 25 seamlessly retracts allowing the cap 10 to appear as a conventional cap.

When both upper and lower members 18 and 20 are snapped closed and locked into place, the oval holes, or openings 22, on the top bill member 20 allows the coaligned male pins 23 on the lower bill member 18 to move side to side (right to left). This allows the wearer to bend or manipulate the closed cap bill while the integrity of the pins remain unchanged and the bill members securely snapped together.

When upper bill member 20 is snapped closed, the upper and lower bill members are locked together as the pins 23 fit into the coaligned holes 22; when the upper bill member 20 is opened by a user, the pins unsnap from the holes manually, the lower curved cut portion 25 then on the top bill portion sliding forward as noted hereinabove into position resting on top of sign board 21 secured to lower bill member 18. The upper bill member 20 is thus locked into place as a result of the cut 25 formed in top bill member 20. Pins 61 and 63 then act as stoppers ensuring bill member 20 does not exceed a 90 degree angle with respect to the lower bill member 18 when flipped open.

Figure 5:
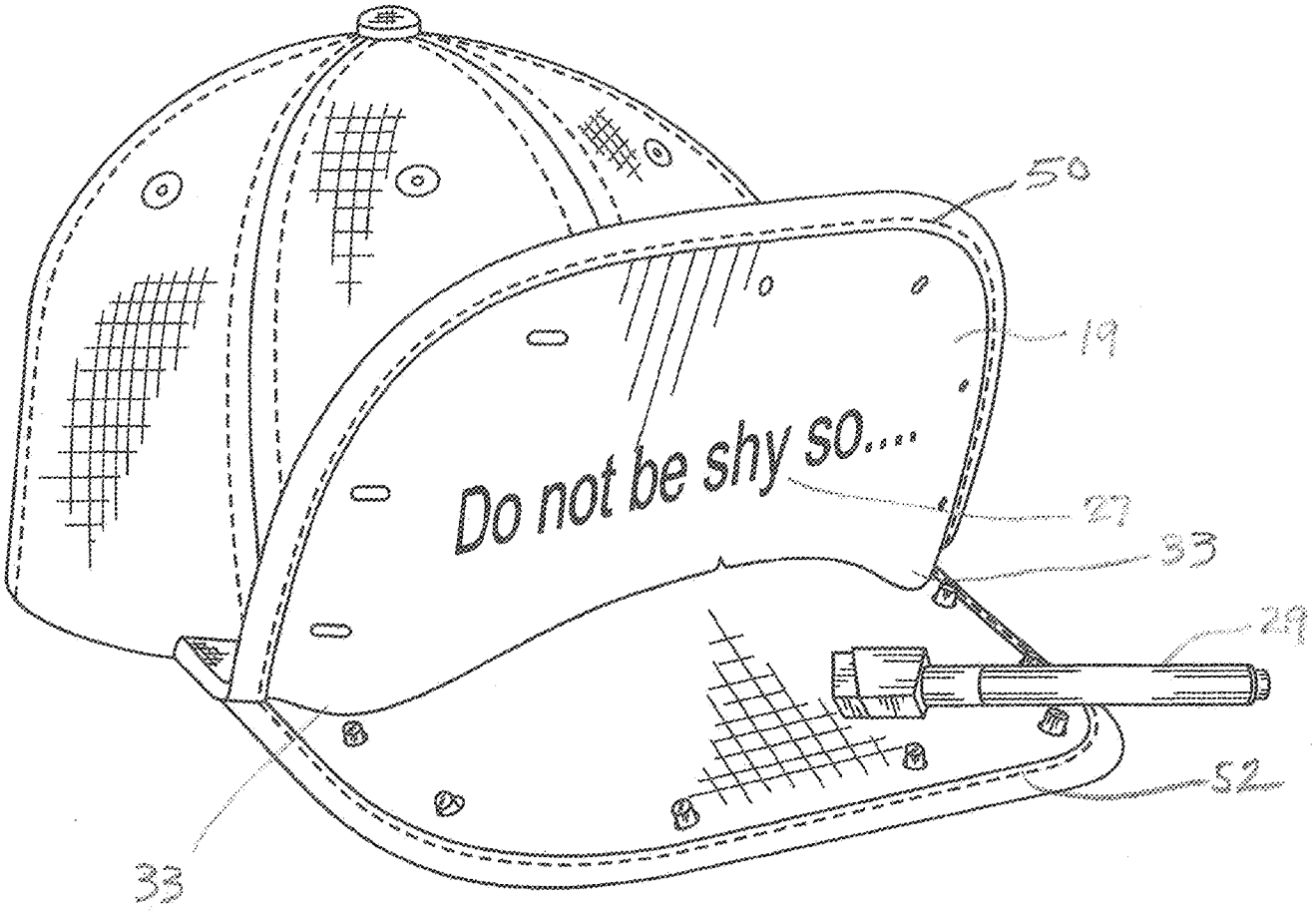
FIG. 5 is a side perspective view showing dry erase material and capability on the surface of the upper bill portion.

There are two essentially parallel sew lines 50 and 52 (the dashed lines as shown in FIG. 5) located on the edges of both the top and bottom signboards 19 and 21; the outer sew lines are used for fabric material covering the lower and upper bill members 18 and 20, respectively. The brim portion (outer portion of both upper and lower bill members as shown in FIG. 5) of the fabric is the only material sewn onto the inside portions of sign boards 19 and 21 and will be sewn in over the outer edge portion of the information printed on signboards 19 and 21.

A fourth method of displaying information is by sewing a clear polyvinyl chloride ("PVC") sleeve into the upper signboard with single opening at top to receive a slide in template insert, the template (or paper) being removable for customization. The template is created by a software program available to a user so that a personalized message can be created on a computer. The message, once created, is printed and then cut to a size such that it can slide into the PVC insert. A separate booklet with die cut tear out templates will also be available for hand decoration.

A fifth method of displaying information is by having both the upper and lower signboards magnetized (or have a magnetic coating applied thereto) so that the end user can decorate the signboards with magnetized decorations.

Figure 2:
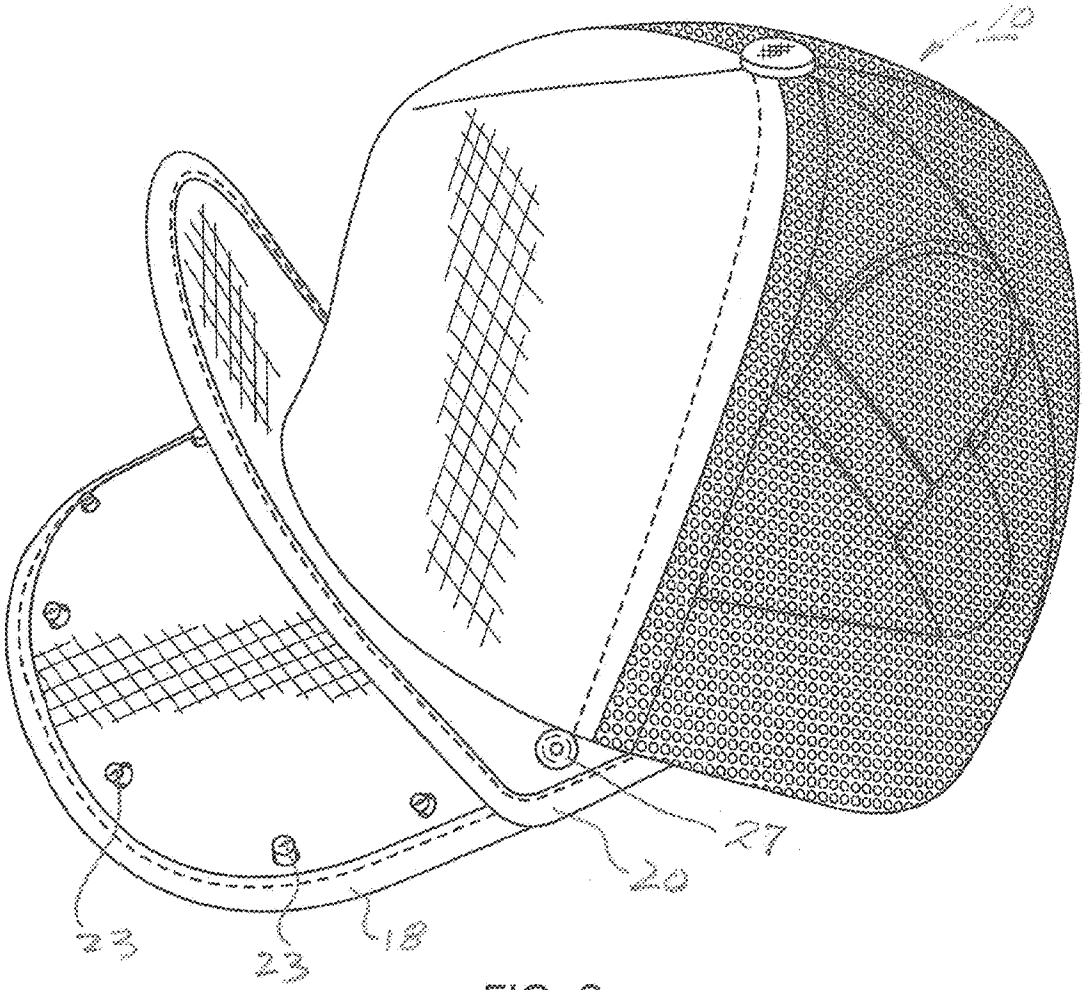
FIG. 2 is a side perspective view illustrating the cap of FIG. 1 with the upper and lower bill portions spaced-apart.

FIG. 2 is a side perspective view of the cap 10 shown in FIG. 1 with the bill portions 18 and 20 spaced apart.

During the cap fabrication process, portions of the satin fabric cap material are sewn over the signboards so they are not removable as noted hereinabove.

The flip cap 10 of the present invention resembles normal caps, but is different in that the upper and lower bill members 18 and 20 are custom molded/engineered to uphold cap functionality when flipped up and also snapped down. When cap 10 is flipped, the exposed surfaces of the signboards function as an advertising display (note that although the exposed surface of signboard 19 alone is the preferred method of displaying information, both signboards can display information at the same time). The upper bill member 20 is somewhat larger in size so bottom bill member 18 is less noticeable when the members are snapped together. In addition, holes 22 are configured to ensure less wear and tear and avoid breakage of the pin bottoms.

The triangular ends 31 (FIGS. 4A and 4B) of signboard 19 are stationary as a result of being sewn into cap 10. The curved cutout 25 allows signboard 19 to remain as one piece while still being able to maintain a flip up and down motion/movement without being separated from top bill member 20 and allows signboard 19 to seamlessly slide back and forth and function as a hinge. Rivets 27 on each side of upper bill member 20 go through corresponding openings 41 formed in lower bill member 18 to secure the upper and lower bill members together without separation even after extended use.

In addition, legs 33 functions as "legs/support structure" for signboard 19, allowing it to move vertically into place. These "legs" act as an important structural support when resting on the lower signboard 21. Because of the curved cutout design, signboard 19 can maintain an upright position in conjunction with a curved lower brim. Maintaining a vertical position is not possible with a straightened flat bill bottom; the cap resembles a flat bill look when it is in the snapped closed position. When upper member 20 is manually flipped up, the pressure created by the legs 33 formed by the curved cut sliding forward automatically gives a slight bend to lower bill member 18 providing a support structure for signboard 19.

When flipped up, legs 33 create pressure on both corners of the lower bill member 18 creating a slight curvature therein. The pressure point creates a slight curvature on the bottom of signboard 21 where the two curved bottom upper bill member portions meet and touch the lower bill signboard 21 (plastic on plastic).

The force created by the pressure point enables signboard 19, and as a result, upper bill member 20, to remain locked in the upper flipped position. The downward force created from the pressure points (produced from manually flipping the bill up) causes a slightly curved lower bill which stabilizes the position of upper bill member 20.

Figure 12:
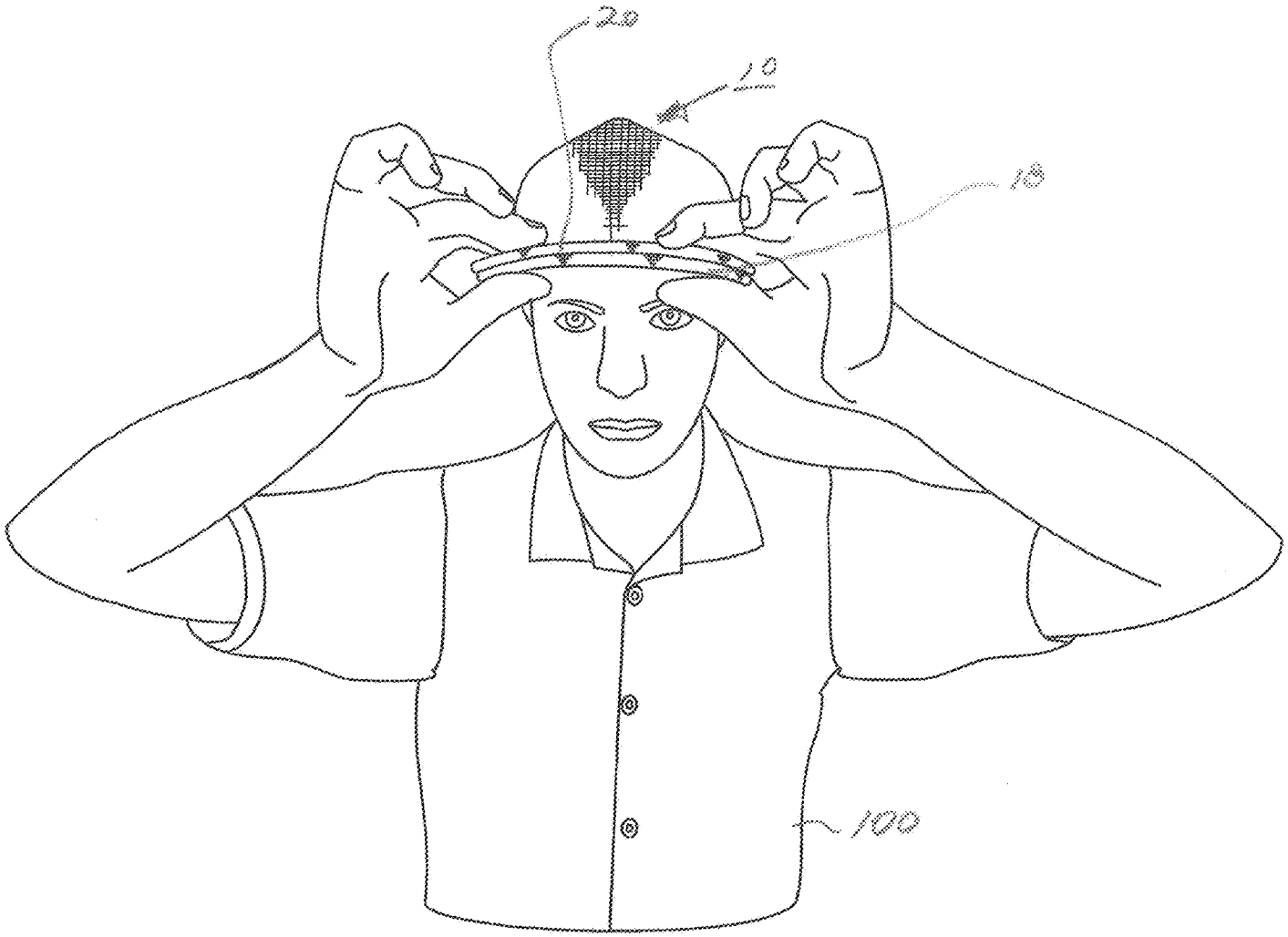
FIG. 12 illustrates a user snapping the two bill portions closed.

The curved cutout 25 seamlessly reverts back into flipped down position aligning with the triangular sewn in pieces 31; then both bills (upper and bottom) snap together back into place, the two separated bills thus becoming integral and appearing as a normal cap (or visor) bill (see FIG. 12). This sequence also aligns the male pins to the female holes, allowing both upper and lower members to seem as one bill when snapped into place (see FIGS. 14(*a*)-14(*c*)).

Pins 61 and 63 ensure that the viewed signboard area is never positioned at more than a 90 degree optimal viewing angle even if the end user bends or curves the bottom bill to adjust for personal comfort.

The steps for producing the cap 10 of the present invention are as follows:

(a) The crown portion of the cap (or visor) is obtained from a manufacturer thereof;

(b) The signboard plastic members 19 and 21 are fabricated in separate molds with the custom features noted hereinabove;

(c) Sublimate artwork is formed on satin material;

(d) The satin material is laser cut to oval and circular openings in the top and bottom bill members;

(e) Glue is applied to bill member and the satin fabric is then heat transferred onto signboards 19 and 21;

(f) Fabric for the lower bill member 18 is sewn over the satin artwork along the edges of signboard 21 to form a brim portion;

(g) Fabric for the upper bill member 20 is sewn over the stain artwork along the edges of signboard 19 to form the brim portion;

(h) Rivets are then punched through the upper bill member 20 and through the lower bill member 18 creating a permanent seal between the bill members;

(i) The formed lower and upper bill members are then sewn together (the material on the top of the upper bill member 20 being sewn to the material on the outside of bottom bill member at a position across where the headboard is to be sewn into cap 10);

(j) The joined lower and upper bill members are, in turn, sewn to the cap crown.

The present invention provides a flip-up cap (or visor) which has a unique mechanism for displaying information to an observer, the cap operating in two modes. In particular, the first mode is when the upper and lower bill members are joined together and extends outward as would a conventional cap bill; the second mode is when the bill members are spaced-apart by being manually flipped up by the user or wearer to display information.

Figure 6:
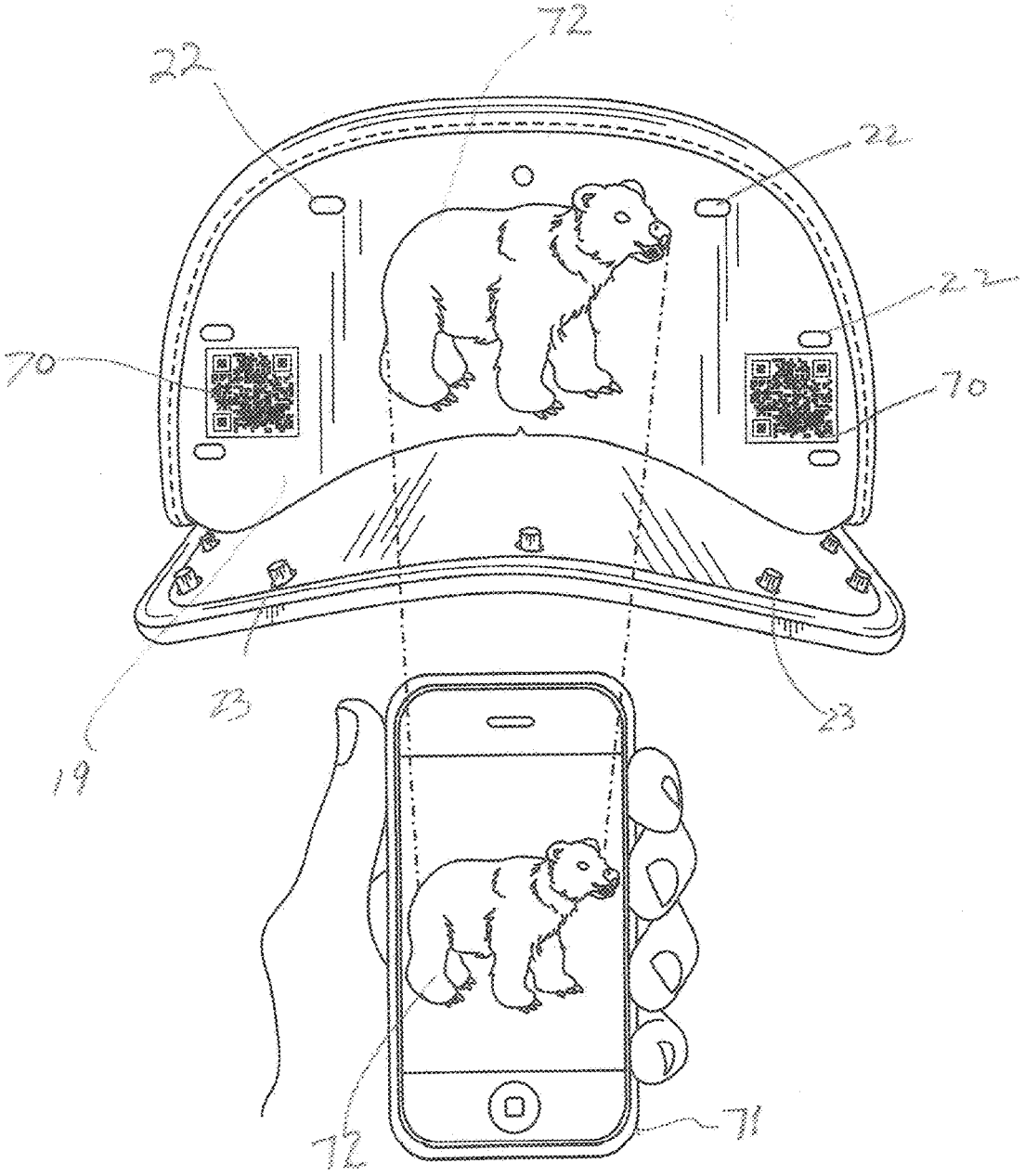
FIG. 6 is a front side perspective view showing the use of a QR code formed on the surface of the upper bill portion as well as an augmented reality code.

FIG. 6 shows, for illustrative purposes, a QR code 70 that is embedded in the artwork so a user can scan the code and be directed to a web page that displays various types of content. Scanning can be done by a mobile phone 71 having the pertinent ready capability. Also shown is an augmented reality (AR) marker, in the form of a bear image 72 printed on the surface of signboard 19.

A user typically would install specific AR software on a smart device, such as a tablet or smart phone. Once installed, this software works with the camera function of the smart device to register said AR marker that is embedded into upper bill member 20. This software will create numerous ways of interacting with that AR marker in real time via the smart device. For example, one can scan the AR marker of the bear and when displayed on the users smart device the bear could then digitally interact with the user in different fashions. The bear may come to life and dance on the cap brim, or a virtual image or video could start to play in real time on the user's smart device.

Figure 7A:
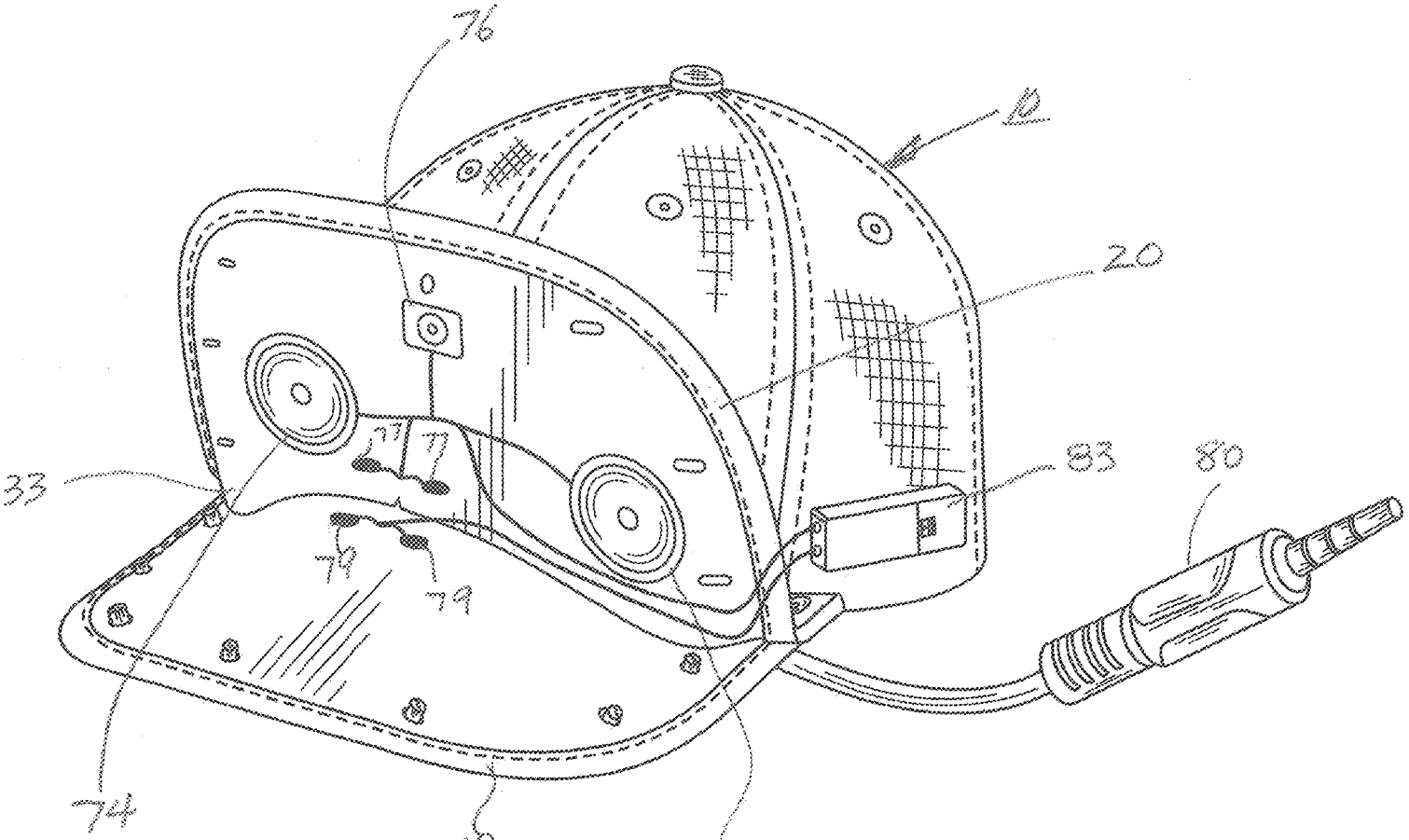
FIGS. 7(*a*) and 7(*b*) illustrate two additional embodiments of the present invention.

FIG. 7*a* shows two different embodiments (shown in one figure for convenience)

1. Built in camera 76 for video recording is mounted flush on the upper bill member 20. A special mold change has a cut out of space to fit the housing of the camera in a flush manner. Camera 76 is powered by a battery storage device 83 that is attached to the outside of cap 10. The on/off function will be activated via connection points 77 and 79 located on both the upper 20 and lower bill members 18, respectively. When bill is open, camera 76 is on; when the bill is closed, camera 76 is off. Wires connect device 83 to the electrically powered components shown on cap 10, i.e. speakers 74, camera 76 and connection points 77 and 79.

2. Built in mini speakers 74 are mounted flush on the upper bill member 20. A special mold has a cut out of space to fit the housing of the speakers in a flush manner. These speakers are wired for power through the battery storage compartment that is attached to the outside of cap 10. An auxiliary speaker cable 80 is wired through to speakers so a user can plug in to any auditory device such as a smart device, MP3 player, computer, etc. The on/off function will be activated via connection points 77 and 79 as noted above.

Figure 7B:
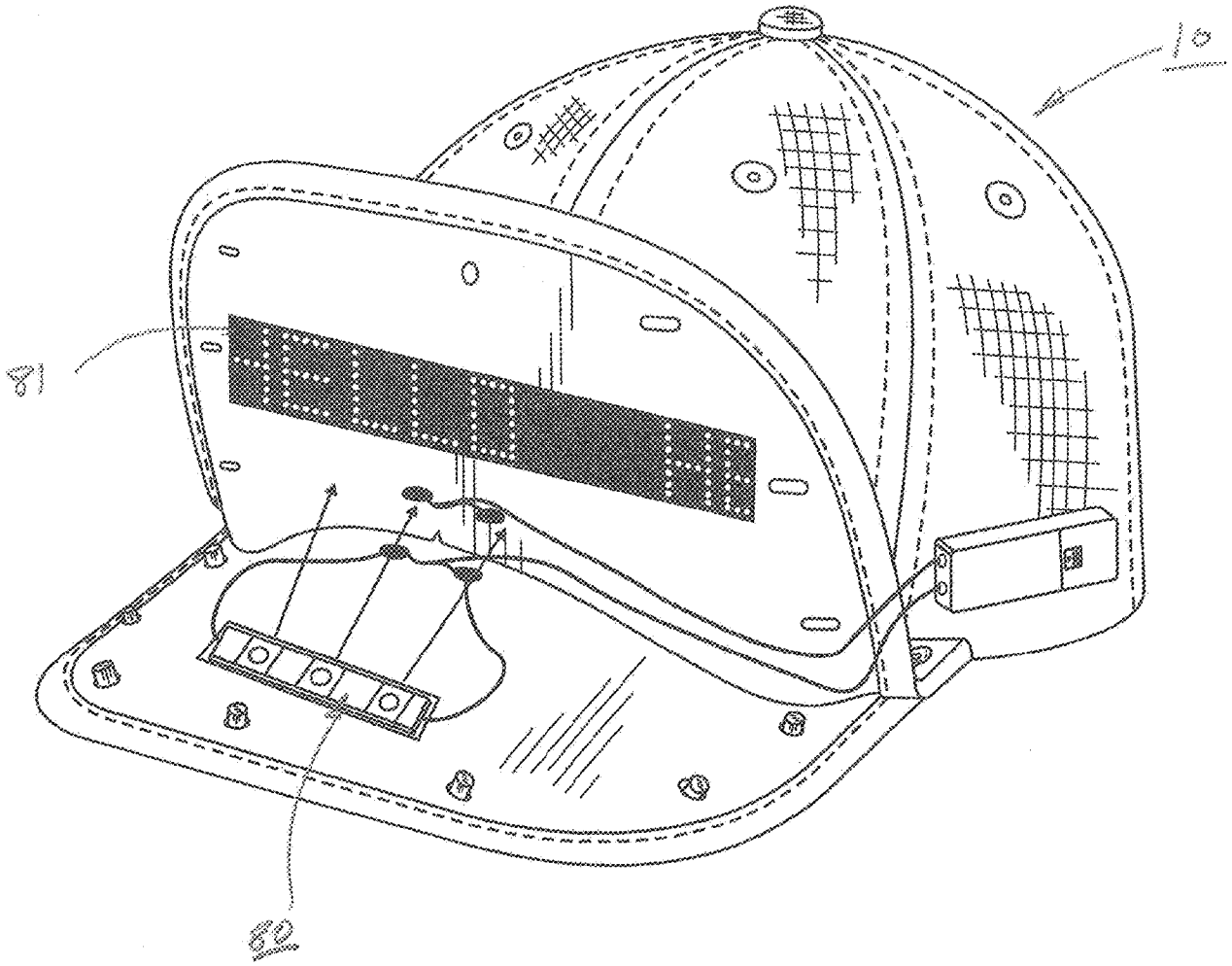

FIG. 7B shows a recessed housing for a plurality of light emitting diodes (LED) 80 to be mounted flush on the lower bill member 18. A special mold has a cut out of space to fit the housing of said plurality of LED in a flush manner. The LEDs are powered by the battery storage compartment that is attached to the outside of cap 10. The on/off function is noted hereinabove. FIG. 7(*b*) also shows a digital display (such as a liquid crystal display (LCD) ticker) which is installed flush with a portion of upper bill member 20 cut for the digital display to nest in.

Figure 8:
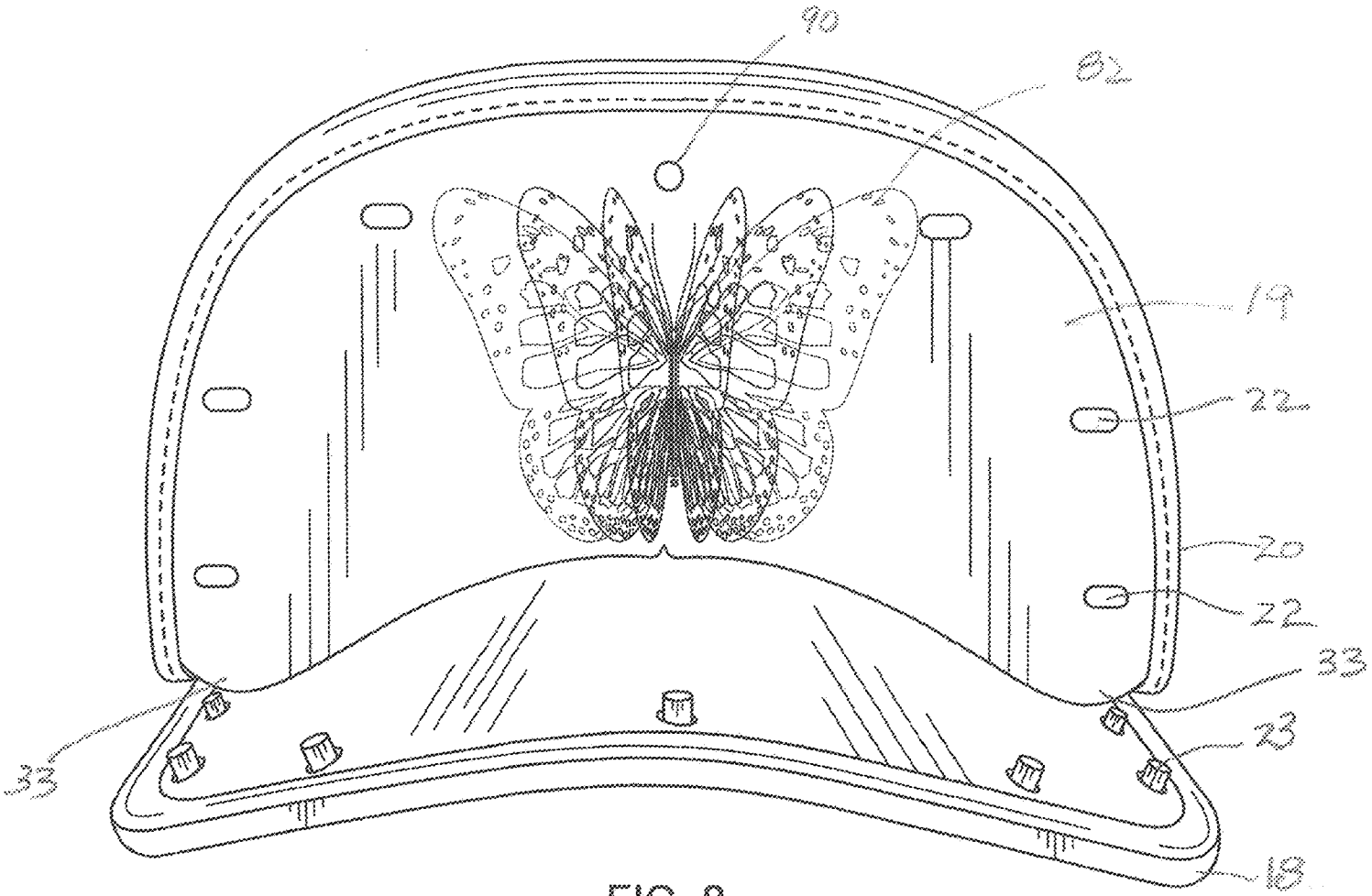
FIG. 8 is a side perspective view illustrating a hologram that portrays a 3D butterfly.
Figure 9:
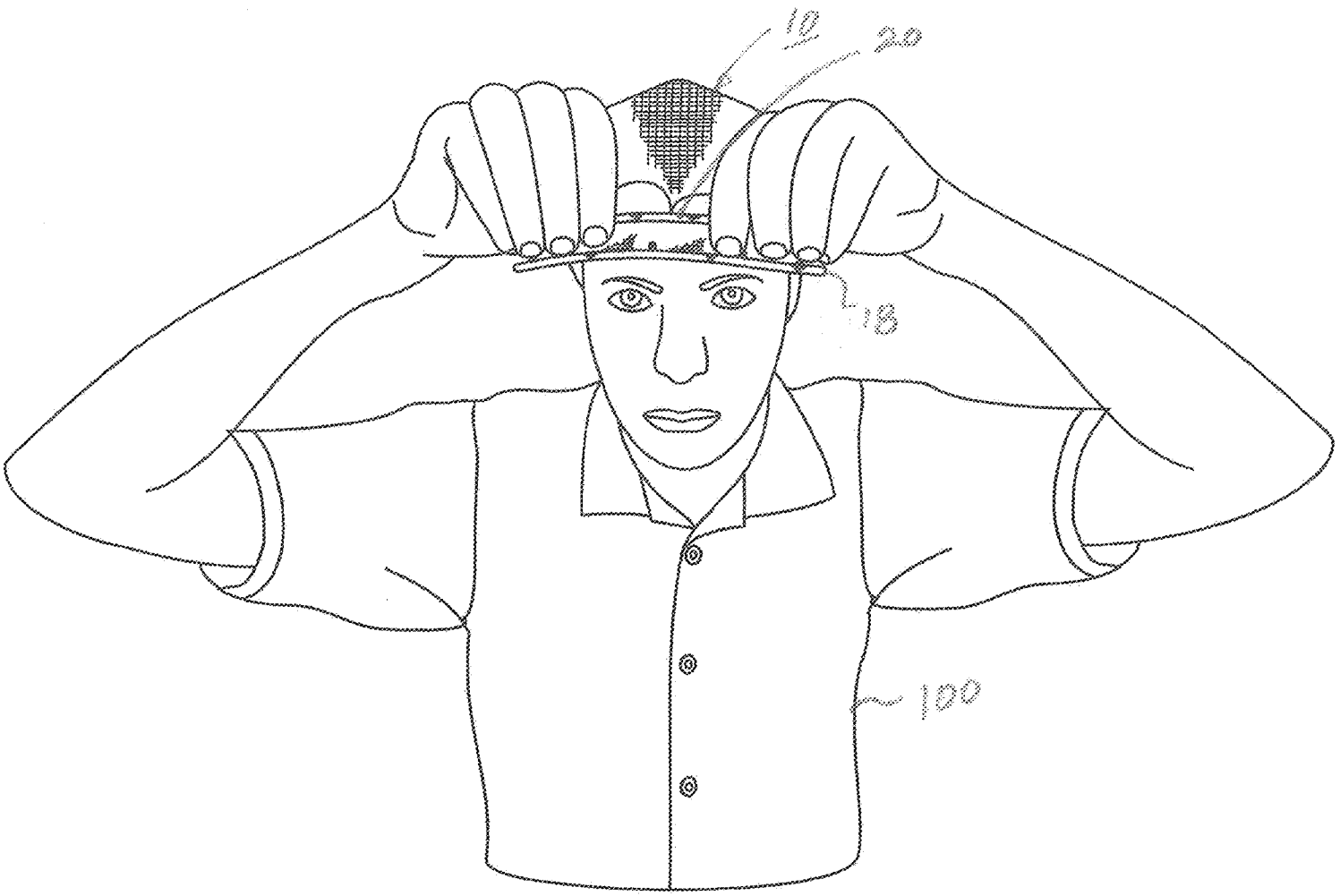
FIG. 9 illustrates a user in position to open the cap.
Figure 10:
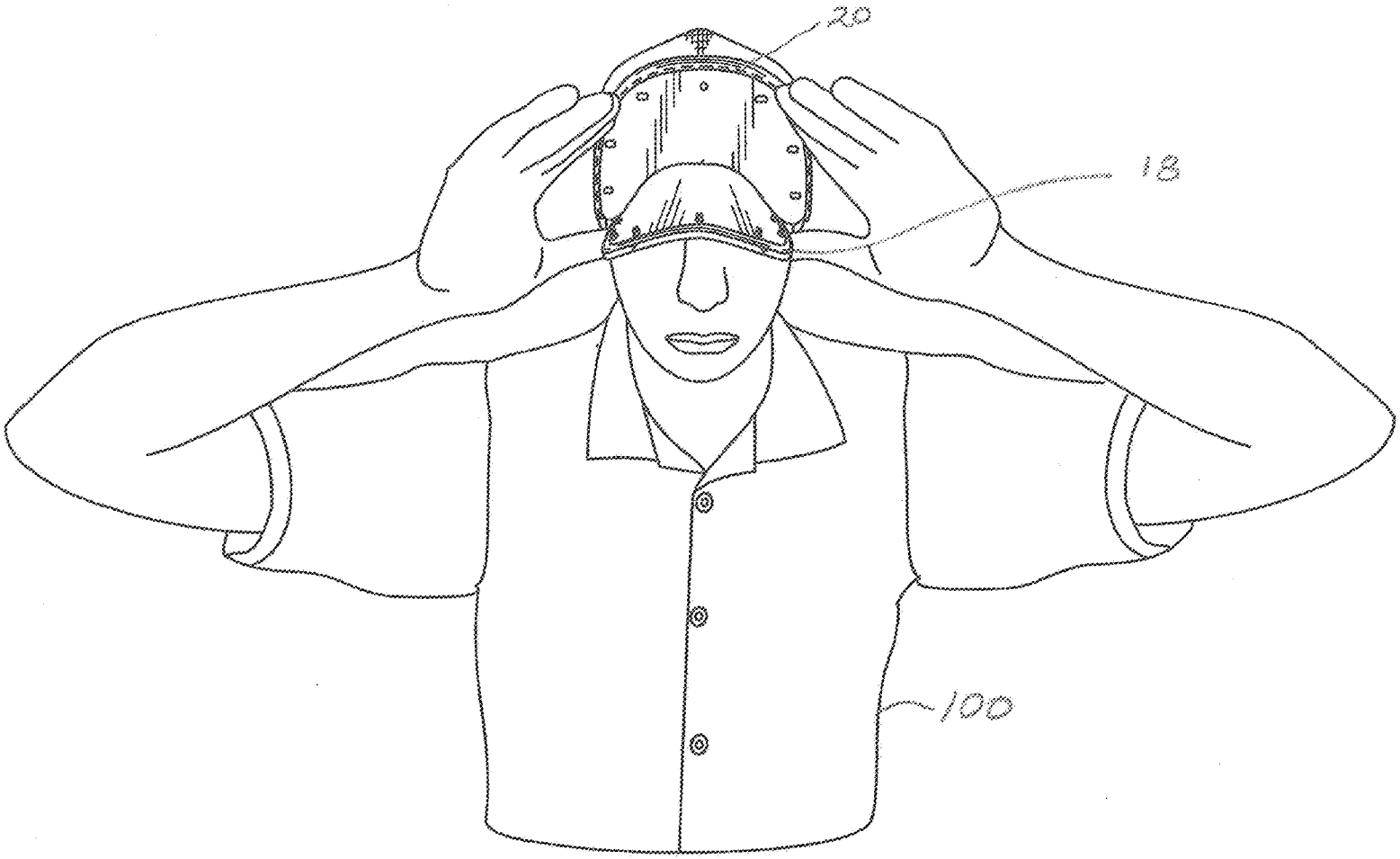
FIG. 10 illustrates a user having opened the bill portions.
Figure 11:
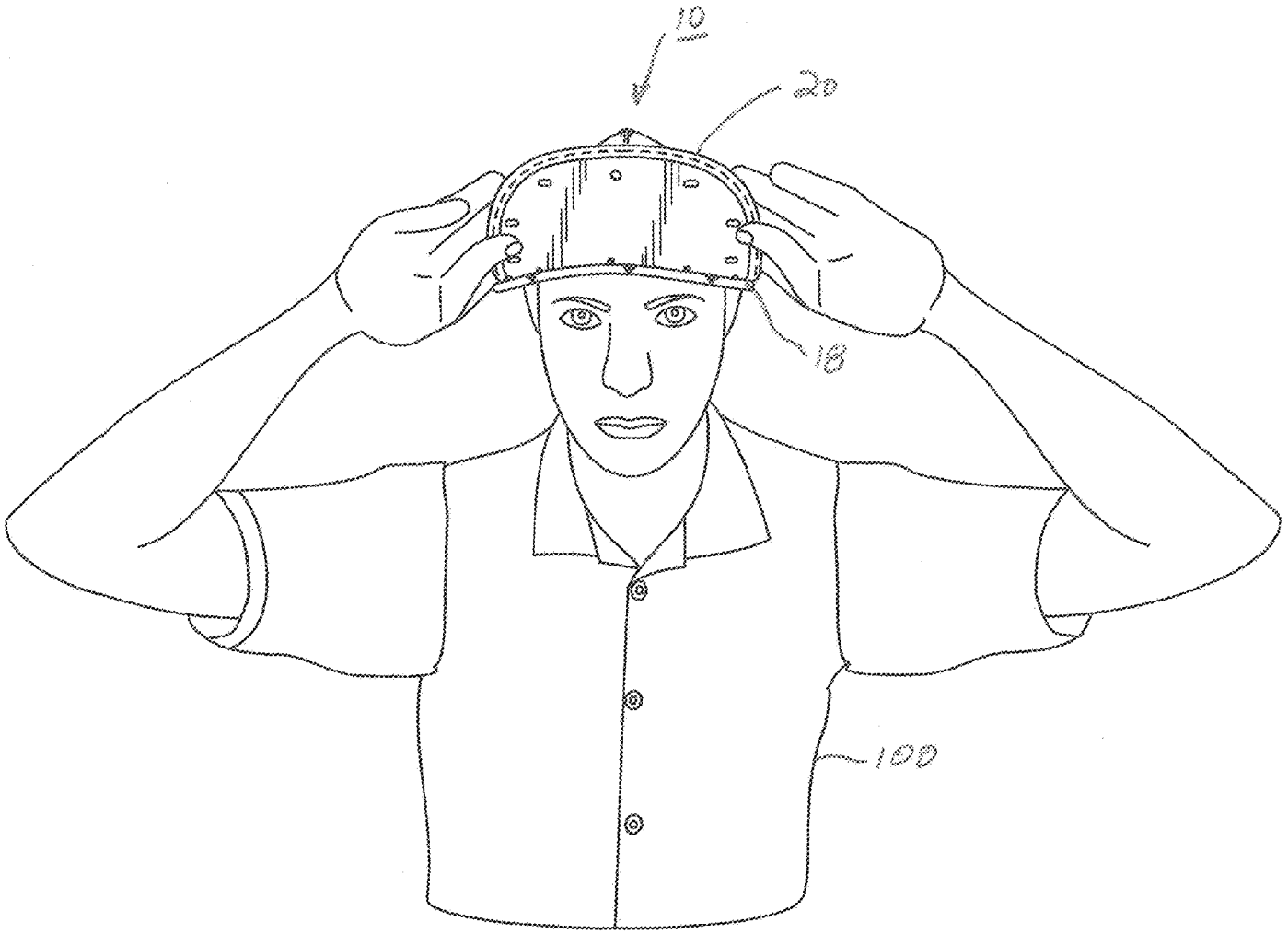
FIG. 11 shows a user in position to close the two bill portions.

Referring to FIG. 8, installing a lenticular lens over the satin printed fabric on upper and lower bill members allows for a 2D image on the bill members to appear as a holographic 3D image creating the illusion of depth and perspective. Both bill members become either the upper or bottom with the layering of the lenticular lens along with the satin printed fabric. Circular middle hole 90 is cut and the other six holes are oval cut as described hereinabove, the lenticular satin print layered members are sewn into the cap to become either an upper or lower bill. The resultant holograph gives the ability for the viewer to visually see the art work move based upon the viewing angle and curvature of both the upper and bottom bill members 20 and 18, respectively.

Figure 13:
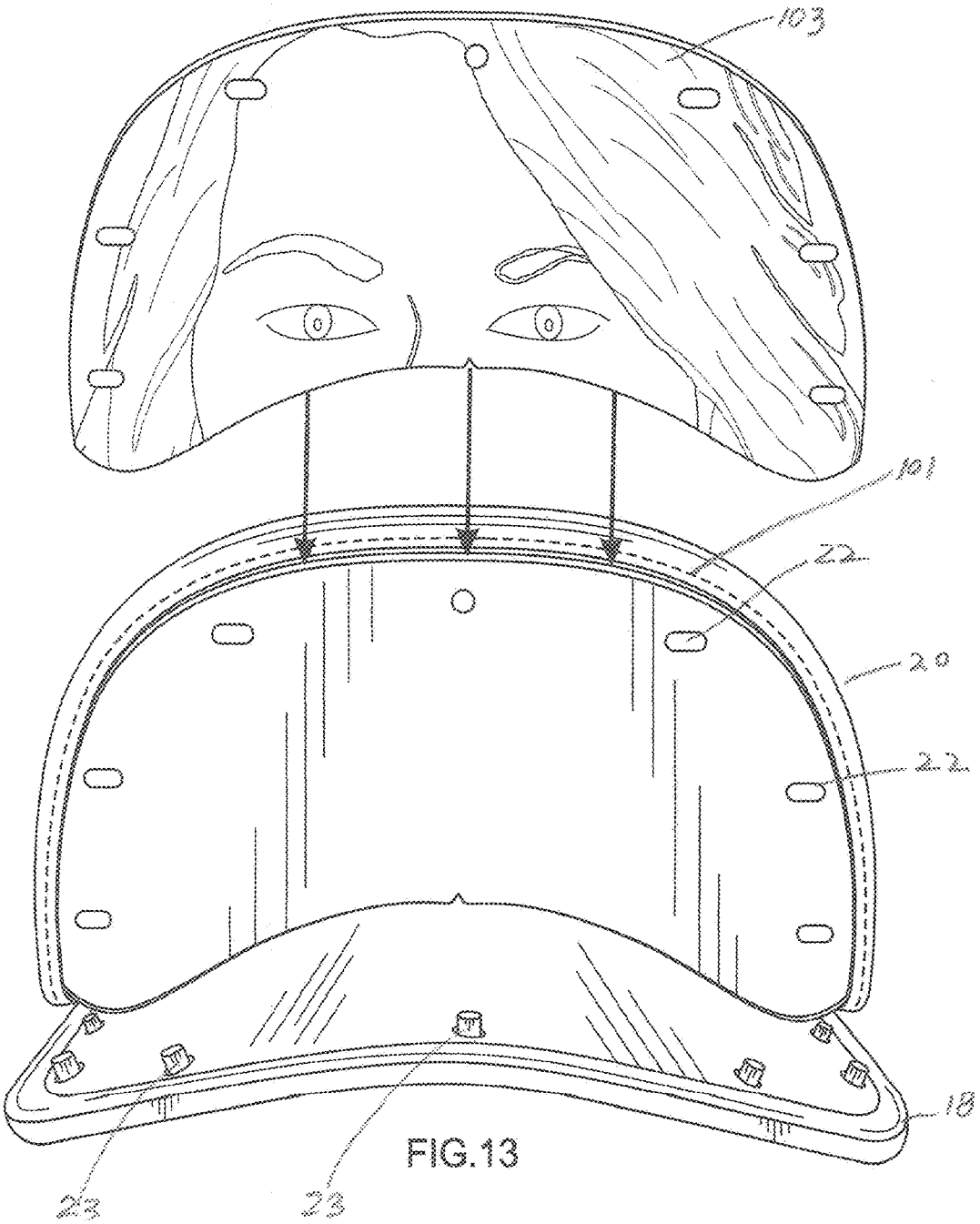
FIG. 13 illustrates another embodiment of the present invention.

Referring to FIG. 13, a thin but durable clear polyvinyl chloride (PVC) sleeve 101 is sewn over the top bill member 20 at the bottom portion, right side portion, and left side portion. The upper portion of the PVC sleeve will not be sewn in at the top portion, but remain open to accept custom inserts. The top portion of the open PVC sleeve will have a small strip of VELCRO™ adhered to it; in conjunction the duplicate size reverse side of the Velcro strip will be adhered directly to the top bill member. When a user creates a custom artwork 103 for the PVC sleeve, a downloadable template with holes to scale of the PC pocket will be available to users to create their own custom artworks to slide into the PVC sleeve. Once the user creates artwork on their computer or smart device they can print, cut, and apply the artwork to the cap. A separate booklet with die cut tear out templates will also be available for hand decoration.

Figure 14A:
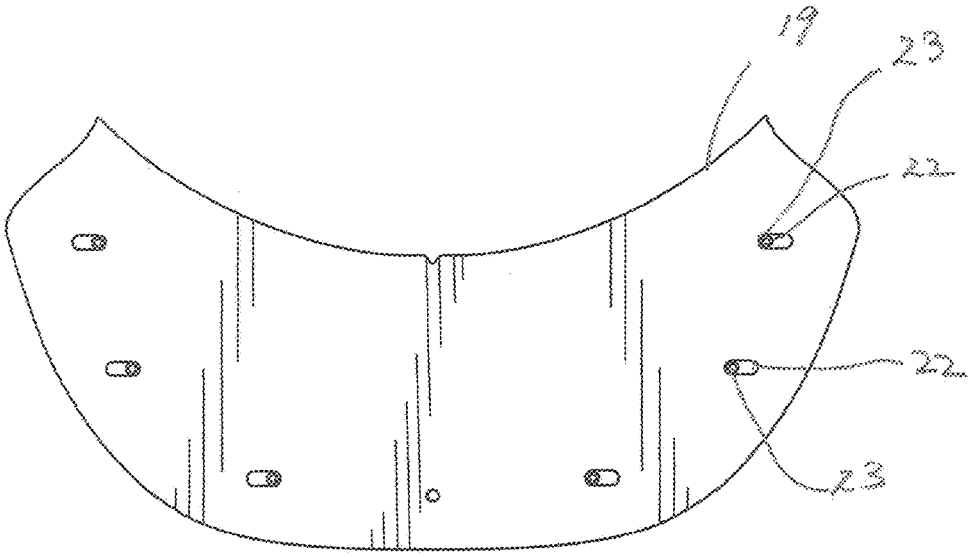
FIGS. 14(*a*)-14(*c*) illustrate a signboard in various positions.
Figure 14B:
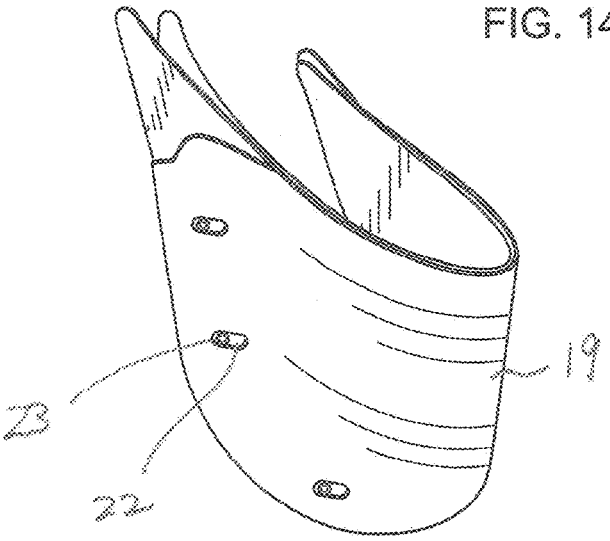
Figure 14C:
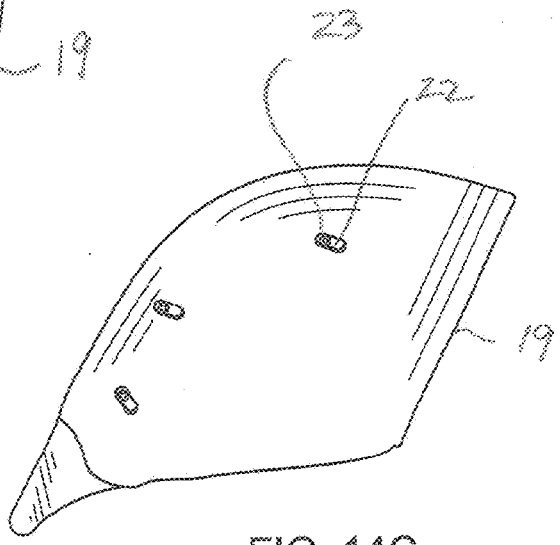

Referring to FIG. 14(*a*), the cap 10 in its original state has both bill member snapped together and locked (note that the view is through cotton fabric covering the upper and lower bill members). The oval shaped cutouts 22 play an important role during the time when the male pins 23 move side to side. When both bill members are snapped together and are curved, the structural integrity of the pins is unaffected because the oval shape allows pins to move back when snapped together. When user flattens bill or bends the sides up, the bottom bill member's pins shift and move inside going towards the center of the bill member. The pins on the bottom bill member shift in between the female ovals of the upper bill member. This happens while both bill members are in a locked and snapped down position.

FIG. 14(*b*) illustrates when a user bends the bill or bends the sides down. In particular, the bottom bill member's pins 23 shift and move outside going towards the edge and outer sides of the brim of the bill member. The pins 23 on the bottom bill member shift in between the female ovals 23 of the upper bill member 20. This happens while both bill members are in a locked and snapped down position. The view of this figure in the drawing is seeing through the cotton fabric covering the bill members.

Figure 15:
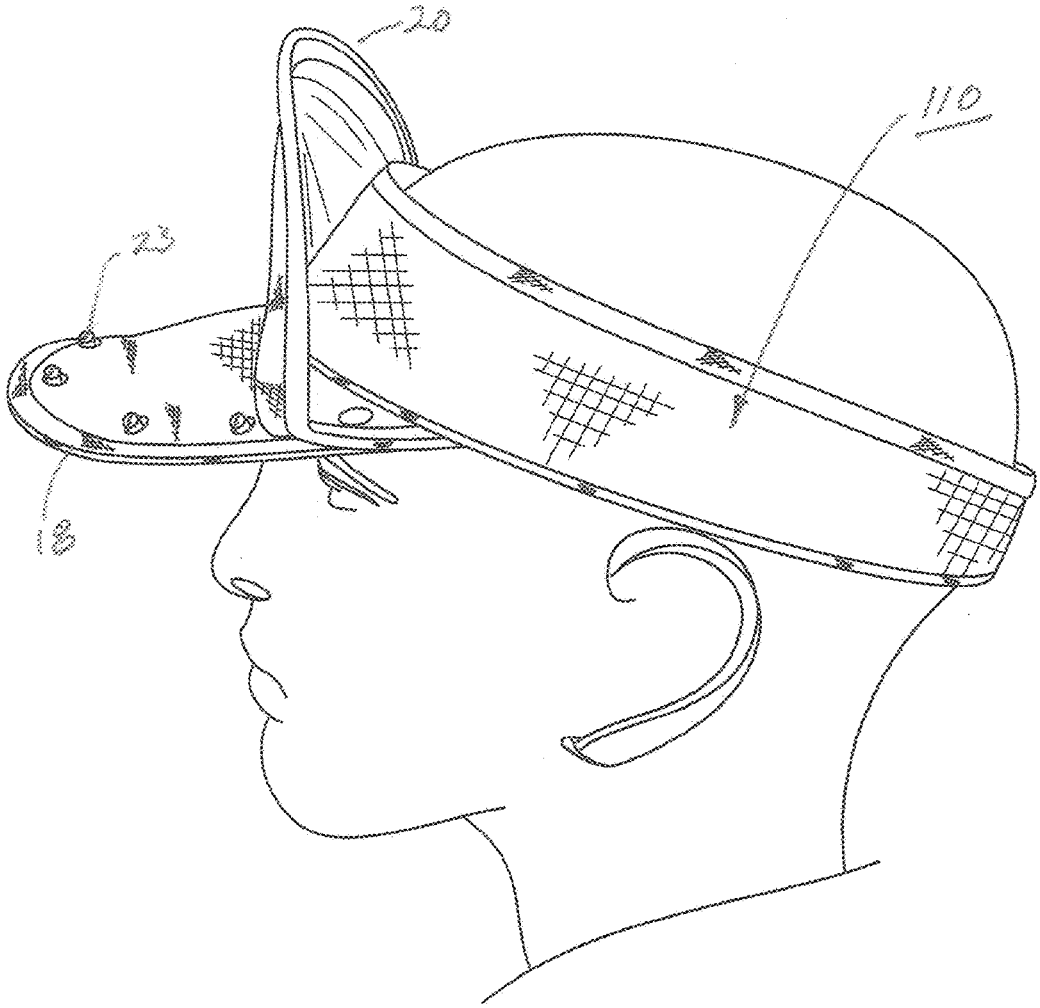
FIG. 15 illustrates a visor incorporating the teachings of the present invention.

FIG. 15 illustrates a visor 110 using the teachings of the present invention and, in particular, showing the visor cap on the user's head providing contour better fit-comfort/sun protection and viewing angles. Using a specific plastic based material in conjunction with an exact tolerance of thickness allows both the upper and lower bill members to be easily curved down when both upper and lower bill are snapped closed. This also permits upper bill member 20 to curve back to the natural contour of a users head. This natural contour bending of the upper bill member provides a more comfortable fit while upper bill portion is in the upright position. The curved rounded contour from the flipped upper bill member around crown of cap provides an improved viewing angle of artwork/signboard to be publicly viewed.

The improved cut on the upper bill member 20 creates lengthened structural legs that stand upright when the upper bill member is flipped up. These legs are positioned at the outermost edges of the lower bill member 18 where the upper and lower bill members meet. This creates more surface area and increased overall height in the upper bill member artboard when flipped open.

The ability to curve the bottom bill member 18 while top bill member 20 is upright allows improved protection from the sun versus a flat, or straight, bottom bill. All the other headgear of similar nature must have their lower bill remain flat when flipped open, while the lower bill member 18 of the present invention preserves a natural curve synonymous with the comfort and style of a classic baseball cap.

Figure 16A:
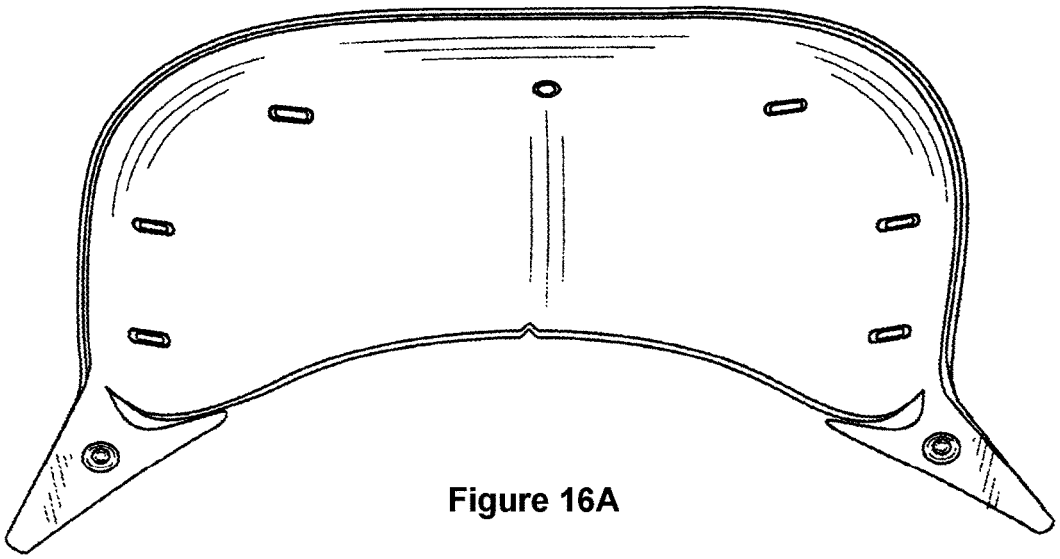
FIGS. 16(*a*)-16(*b*) illustrate different techniques for enabling information to be displayed on the cap.
Figure 16B:
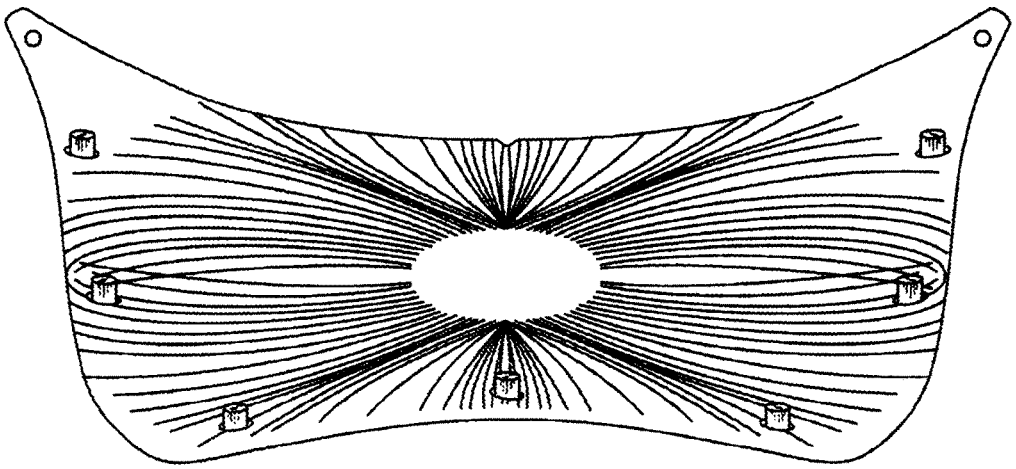

FIG. 16(*a*) illustrates the use of an improved printing material suitable for applying to plastics made from satin cloth fabric as seen by a thin layer of material covering the top bill member 20. FIG. 16(*a*) also shows how a thin magnetized piece of material will be applied, as this is the same process as set for the satin material. This satin fabric's elasticity is key as it plays an important role when applied to the inside of the upper and lower bill members. After the satin cloth material is applied to the upper and lower bill members, they now become one cohesive piece, which allows for increased bendability and product lifespan. FIG. 16(*b*) illustrates how the magnetic shavings are injected inside of the plastic during the molding process; thus creating one plastic piece that is magnetized. This then allows applying satin fabric over a magnetic plastic piece.

In essence, this same process described above can also be used with a thin magnetic sleeve as shown in FIG. 16(*a*). The holes and size of the magnetic sleeve is to scale; this will be applied to upper and lower bills and then sewn in just as the satin fabric is.

Magnetic shavings can be infused into the plastic prior to molding; the effect (as shown in FIG. 16(*b*) is that it is already incorporated into the upper and lower bill members. Plastic magnetized detachable magnetic trinkets/accessories can then be placed on caps 10.

An alternate process of applying artwork on the upper and lower bill members uses sublimation heat transfer onto a satin cloth fabric. This procedure starts with a 4-color process artwork sublimated to satin fabric. Next, the sublimated fabric, a specialized laser cutting machine is used to produce perfect oval openings for the upper bill member 20 as well as perfect circular openings cut into the fabric for lower bill member 18. Because the laser cut holes in both the lower and upper bill portion are precise, it eliminates cutting by hand. A steel mold shaped to accept both upper and lower bill members is heated to a specific tolerance so the plastic is not melted. The satin cloth fabric is glued to the upper and lower bill portions (these bill portions must be rough and unpolished to ensure a permanent seal with the glue). The custom steel mold heat machine then firmly presses down on the bill members and fabric to make the satin cloth and bill one item. This process is done to both upper and lower bill members separately. The use of satin cloth fabric for this is an improvement over prior art artwork processes because the 4-color process satin cloth sublimated fabric is thinner, more versatile, has more elasticity, is water resistant, and is crease resistant. Once the satin cloth is applied to both upper and lower bill members, they are sewn into the bill plastic and secured by the brim fabric covering sewn over the cloth.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A head apparel comprising a crown portion comprising material that at least forms a circumferential shape adapted to encompass a human head;

a lower bill member being rigid and permanently fixed from an outer side of said crown portion; and, an upper bill member having a first corner and a second corner that are fixed to said lower bill member, said upper bill member comprising:

a rigid plastic board having two raised leg portions on each side of a concave portion, each of which is formed from a single, continuous curved lower edge of said rigid plastic board; and a fabric portion connected to and disposed over a first surface of said rigid plastic board;

wherein said upper bill member is movable from a first position in which said upper bill member is substantially parallel with said lower bill member, and a second position in which said upper bill member is substantially perpendicular with said lower bill member; and, wherein said two raised leg portions of said rigid plastic board are exposed in said second position and slide forward and rest on said lower bill member when moved from said first position to said second position.

2. The head apparel of claim 1, wherein said head apparel forms a visor where said crown portion which is configured to encompass a human head is absent, or wherein said crown portion includes material forming a concave shape such that said head apparel forms a baseball hat.

3. The head apparel of claim 1, further comprising an attachment mechanism comprising a pin and an aperture aligned with said pin; said attachment mechanism maintaining said upper bill member in said first position.

4. The head apparel of claim 1, further comprising an attachment mechanism comprising a snap aligned to maintain said upper bill member in said first position.

5. The head apparel of claim 1, wherein said upper bill member has a polished surface configured for use with a dry erase marker.

6. The head apparel of claim 1, further comprising a camera fixed within said upper bill member and a switch configured to activate said camera when said upper bill member is in said second position.

7. The head apparel of claim 1, further comprising speakers fixed within said upper bill member.

8. The head apparel of claim 1, further comprising a digital display comprising a light emitting diode display or a liquid crystal display.

9. The head apparel of claim 1, further comprising a lenticular lens disposed on said upper bill member.

10. A head apparel comprising a crown portion comprising material that at least forms a circumferential shape comprising:

a lower bill member being rigid and permanently fixed from an outer side of said crown portion;

an upper bill member having a first corner and a second corner that are fixed to said lower bill member, said upper bill member comprising:

a rigid plastic board having two raised leg portions on each side of a concave portion, each of which is formed from a single, continuous curved lower edge of said rigid plastic board; and a fabric portion connected to and disposed over a first surface of said rigid plastic board;

wherein said upper bill member is movable from a first position in which said upper bill member is substantially parallel with said lower bill member, and a second position in which said upper bill member is substantially perpendicular with said lower bill member; and, wherein said two raised leg portions of said rigid plastic board are exposed in said second position and engage a top surface of said first bill member wherein said first corner and said second corner are fixed to said lower bill member via rivets.

11. A head apparel comprising a crown portion comprising material that at least forms a circumferential shape adapted to encompass a human head;

a lower bill member being rigid and permanently fixed from an outer side of said crown portion; and, an upper bill member having a first triangular corner and a second triangular corner that are fixed to said lower bill member; said upper bill member comprising:

a rigid plastic board having a single continuous lower edge forming two raised leg portions separated by a center, reduced area, and a fabric portion disposed over a first surface of said rigid plastic board;

wherein said upper bill member is movable from a first position in which said upper bill member is disposed on top of said lower bill member, and a second position in which said upper bill member is substantially perpendicular with said lower bill member; and, wherein said curved lower edge of said rigid plastic board slides forward and rests on a top surface of said lower bill member when moved from said first position to said second position, so as to maintain said upper bill member in said second position.

12. The head apparel of claim 11, further comprising an attachment mechanism comprising a pin and an aperture aligned with said pin; said attachment mechanism maintaining said upper bill member in said first position.

13. The head apparel of claim 12, wherein said aperture is located in said rigid plastic board.

14. The head apparel of claim 11, wherein said upper bill member has a polished surface configured for use with a dry erase marker.

15. The head apparel of claim 11, wherein said rigid plastic board has a second surface that is exposed in said second position and is configured for use with dry erase markers.

16. The head apparel of claim 11, wherein said upper bill member further comprises a camera, a speaker, a liquid crystal display, a light emitting diode display, or a lenticular lens.

17. A head apparel comprising a crown portion comprising material that at least forms a circumferential shape adapted to encompass a human head;

a lower bill member being rigid and permanently fixed from an outer side of said crown portion; and, an upper bill member connected to said lower bill member and comprising:

a rigid plastic board having a single, continuous lower edge forming two raised leg portions, and a fabric portion connected to and disposed over a first surface of said rigid plastic board;

wherein said upper bill member is movable from a first position in which said upper bill member is substantially parallel with said first bill member, and a second position in which said upper bill member is substantially perpendicular with said lower bill member; and, wherein said lower edge of said rigid plastic board slides forward and rests on a top surface of said lower bill member when moved from said first position to said second position, so as to maintain said upper bill member in said second position.

* * * * *